US005531579A

United States Patent [19]

Fukanuma et al.

[11] Patent Number: 5,531,579

[45] Date of Patent: Jul. 2, 1996

[54] SCROLL TYPE COMPRESSOR

[75] Inventors: Tetsuhiko Fukanuma; Kunifumi Goto, both of Kariya; Yuichi Tsumagari, Toyokawa; Shigeki Iwanami, Okazaki, all of Japan

[73] Assignees: Kabushiki Kaisha Toyoda Jidoshokki Seisakusho; Nippondenso Co., Ltd., both of Kariya, Japan

[21] Appl. No.: 376,839

[22] Filed: Jan. 23, 1995

[30] Foreign Application Priority Data

Jan. 25, 1994 [JP] Japan ..... 6-6650

[51] Int. Cl.[6] ..... F01C 1/04

[52] U.S. Cl. ..... 418/55.2; 29/888.022

[58] Field of Search ..... 418/55.1, 552; 29/888.022, 889.7, 527.6

[56] References Cited

U.S. PATENT DOCUMENTS

| | | | |
|---|---|---|---|
| 4,527,964 | 7/1985 | Mitsu et al. | 418/55.2 |
| 4,811,471 | 3/1989 | Etemad et al. | 29/888.022 |
| 4,908,077 | 3/1990 | Nakamura et al. . | |
| 4,929,160 | 5/1990 | Inoue | 418/55.2 |
| 5,037,278 | 8/1991 | Fujio et al. | 418/55.2 |
| 5,173,042 | 12/1992 | Chambers | 418/55.1 |
| 5,290,161 | 3/1994 | Swain . | |
| 5,392,512 | 2/1995 | Fann et al. | 29/888.02 |

FOREIGN PATENT DOCUMENTS

| | | |
|---|---|---|
| 0457603 | 11/1991 | European Pat. Off. . |
| 0513827 | 11/1992 | European Pat. Off. . |
| 0520431 | 12/1992 | European Pat. Off. . |
| 9323671 | 11/1993 | WIPO . |

OTHER PUBLICATIONS

European Search Report for European Patent Appln. No. 95 10 0905, May 22, 995.

*Primary Examiner*—Charles Freay

*Attorney, Agent, or Firm*—Brooks Haidt Haffner & Delahunty

[57] ABSTRACT

A scroll type compressor has a fixed scroll in a housing and a movable scroll opposed to the fixed scroll to define a compression chamber with the fixed scroll. Gas introduced into a suction chamber via an inlet is compressed in the compression chamber and then is discharged to a discharge chamber via a discharge port to exhaust the compressed gas from an outlet to the outside of the compressor in accordance with the circular movement of the movable scroll. A part of the discharge chamber is defined in the fixed scroll. An outlet flange protrudes from the fixed scroll. The outlet flange includes the outlet which communicates with the discharge chamber.

13 Claims, 5 Drawing Sheets

SCROLL TYPE COMPRESSOR

BACKGROUND OF THE INVENTION

1. Field of the invention

This invention relates to a scroll type compressor to be employed, for example, in an automotive air conditioner. More particularly, the present invention relates to the structure of an outlet for discharging a compressed gas from the housing of the compressor to an external piping.

2. Description of the Related art

A typical scroll type compressor is provided with a housing in which a fixed scroll is accommodated. The fixed scroll has a base plate and a spiral element. A rotary shaft is supported at the front side of the housing via a bearing, and an eccentric pin is attached to the inner end of the rotary shaft. A movable scroll having a boss at the front surface of its base plate is provided. The boss engages the eccentric pin via a bushing and a bearing so as to rotate relative to the eccentric pin. The spiral element of the movable scroll meshes with the spiral element of the fixed scroll at staggered angles.

An anti-rotation mechanism is interposed between the movable scroll and a fixed pressure receiving wall of the housing. This mechanism prohibits rotation of the movable scroll and allows orbital movement thereof. Compression chambers are defined between the spiral element of the fixed scroll and that of the movable scroll. The volume of the compression chambers or pockets is reduced as they are moved from the periphery toward the center under the orbital movement of the movable scroll. Thus, a refrigerant gas is compressed in the pockets.

Furthermore, in the conventional compressor described above, as shown in FIG. 9, a rear housing 42 is fixed to the rear side of a base plate 4*a* of a fixed scroll 41. The rear housing 42 is provided with a discharge chamber 43 for temporarily storing the high-pressure refrigerant gas discharged through a discharge port 41*c* of the base plate 4*a* so as to moderate surging of the gas. An outlet flange 42*a* is formed integrally with the rear housing 42 on the outer circumferential wall thereof. The outlet flange 42*a* has an outlet 42*b* for leading the gas in the discharge chamber 43 to an external refrigerant piping.

In the conventional compressor, the outlet flange 42*a* is formed on the outer peripheral wall of the rear housing 42. Accordingly, the depth L of the rear housing 42 in the axial direction of the compressor cannot be made smaller than the diameter D of the outlet flange 42*a*. This undesirably lengthens the compressor.

It has been proposed to form an outlet flange on the rear side wall of the rear housing. However, such a structure also increases the length of the compressor.

SUMMARY OF THE INVENTION

It is an object of the present invention to provide a scroll type compressor which can be shortened and lightened.

In order to attain the intended object described above, a compressor according to the present invention has a fixed scroll disposed in a housing and also a movable scroll disposed to oppose to the fixed scroll so as to define a compression chamber between these two scrolls. As the movable scroll makes a circular orbital movement, the gas introduced through an inlet to a suction chamber is compressed in the compression chamber and then discharged through a discharge port into the discharge chamber to be exhausted through an outlet to the outside of the compressor. The discharge chamber is at least partly defined in the fixed scroll. The outlet flange protrudes from the fixed scroll outward and is provided with an outlet communicating to the discharge chamber.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
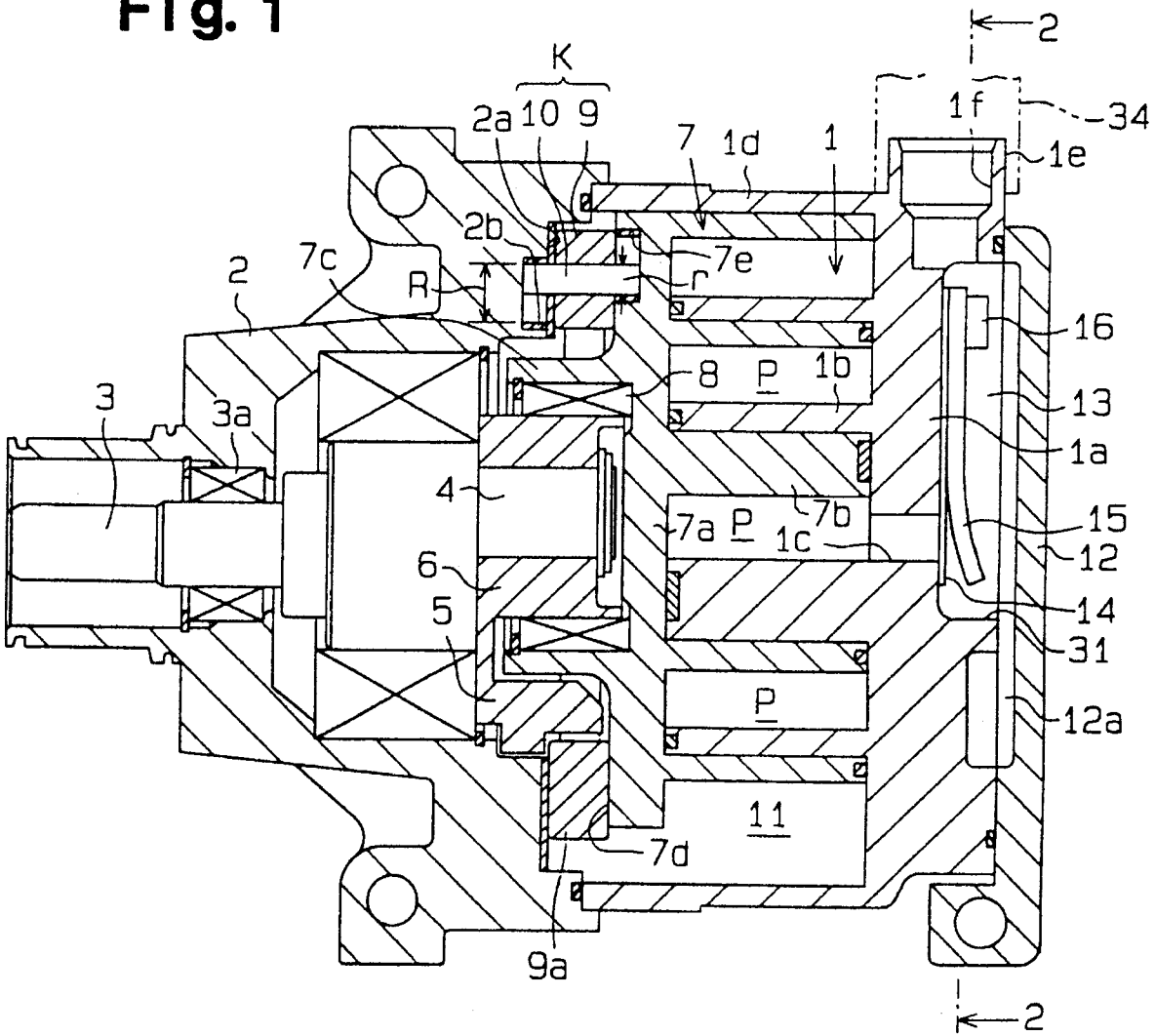
FIG. 1 is a vertical cross-sectional view of the scroll type compressor according to a first embodiment of the invention.
Figure 2:
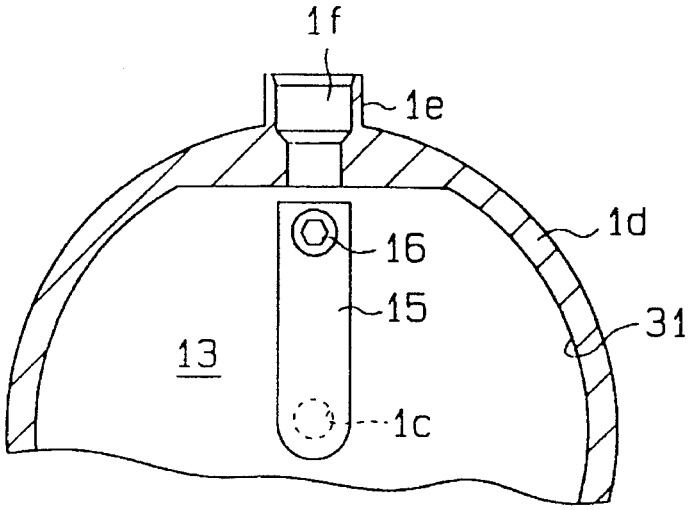
FIG. 2 is a partial cross-sectional view taken along the line 2—2 of FIG. 1.

A first embodiment of the present invention will now be described in detail referring to FIGS. 1 to 3. As shown in FIG. 1, a fixed scroll 1 serves as a center housing 1*d*, and a front housing 2 is fixed to the fixed scroll 1. A rotary shaft 3 is rotatably supported via a bearing 3*a* in the front housing 2. An eccentric pin 4 is secured to the rotary shaft 3.

A balancer weight 5 and a bushing 6 are rotatably attached to the eccentric pin 4. A movable scroll 7, which meshes with the fixed scroll 1, is rotatably supported via a radial bearing 8 by the bushing 6. These two scrolls 1, 7 are provided with base plates 1*a*, 7*a* and spiral elements 1*b*, 7*b* formed integrally with the associated base plates, respectively. The fixed base plate 1*a* is located at a rear part of the compressor, whereas the movable base plate 7*a* is located substantially at the center of the compressor. A boss 7*c*, in which the bushing 6 is to be fitted, is formed integrally with the movable base plate 7*a* at the front surface thereof. A plurality of compression chambers P are defined between the base plates 1*a*, 7*a* and the spiral elements 1*b*, 7*b*.

The front surface of the movable base plate 7*a* comprises a movable pressure receiving wall 7*d*. A fixed pressure receiving wall 2*a* is formed on the inner surface of the front housing 2. An anti-rotation mechanism K is interposed between these two pressure receiving walls 2*a*, 7*d*. This mechanism K prohibits rotation of the movable scroll 7 about its own axis, but permits orbital movement around the axis of the rotary shaft 3.

To describe more specifically, the anti-rotation mechanism K has a plurality of recesses 2*b* (four recesses in this embodiment) formed on the fixed pressure receiving wall 2*a*. This mechanism K also has a plurality of recesses 7*e* formed on the movable base plate 7*a*, which are offset a predetermined distance from the recesses 2*b* respectively. A ring 9 is interposed between these pressure receiving walls 2*a*, 7*d*. A plurality of pins 10 are inserted into the ring 9, and the pins 10 are engaged with the inner circumferences of the recesses 2*b*, 7*e*, respectively.

Furthermore, a plurality of elements 9*a* are formed integrally with the ring 9 on the front side and rear side thereof at a predetermined interval. These elements 9*a* are directed to transmit the force resulting from the pressure of the compressed refrigerant gas from the movable pressure receiving wall 7*d* to the fixed pressure receiving wall 2*a*.

An inlet (not shown) is defined in the front housing 2, and a suction chamber 11 is defined between the movable scroll 7 and the inner surface of the front housing 2. A rear housing 12 is fixed to the rear surface of the fixed base plate 1*a*. A recess 31 is defined on the rear surface of the fixed base plate 1*a*. A discharge chamber 13 includes a recess 31 and an inner space 12*a* of the rear housing 12. A discharge port 1*c* is formed in the fixed base plate 1*a*, and a discharge valve 14 for opening and closing the discharge port 1*c* is provided in the discharge chamber 13. This discharge valve 14 is fixed to the base plate 1*a*together with a retainer 15 by a bolt 16.

An outlet flange 1*e* is formed integrally with the fixed base plate 1*a*on the outer circumference thereof. The outlet flange 1*e* has an outlet 1*f* formed adjacent to the recess 31, and the outlet 1*f* communicates via the recess 31 to the discharge chamber 13. An external refrigerant piping 34 can be connected to the outlet flange 1*e*. The fixed scroll 1 is molded together with the center housing 1*d* by means of hot chamber type die-casting method. In die-casting the fixed scroll 1, a molten aluminum alloy is poured through a gate 22 into a cavity 23 defined between a pair of molding dies 20, 21, as shown in FIG. 3. The gate 22 has an inner diameter suitable for forming the outlet flange 1*e*. Accordingly, the columnar section molded in the gate 22 can be utilized as the outlet flange 1*e*. The outlet 1*f* can be formed through this outlet flange 1*e*by drilling and the like.

Next, the action of the thus constituted compressor will be described. When the eccentric pin 4 is revolved under rotation of the rotary shaft 3, the bushing 6 is allowed to make an orbital movement along a predetermined radius of circular orbit around the axis of the rotary shaft 3. Thus, the movable scroll 7 makes an orbital movement around the rotary shaft 3 while the rotation of the movable scroll 7 about its own axis is prohibited by the anti-rotation mechanism K. The plurality of pins 10 in the anti-rotation mechanism K are engaged to the fixed recesses 2*b*, so that rotation of the movable scroll 7 around its axis is prohibited. Furthermore, since the pins 10 are engaged with the fixed recesses 2*b* and the movable recesses 7*e*, the movable scroll 7 makes an orbital movement along a circular orbit having an orbital radius substantially represented by subtracting "r" from "R" (R–r), where "R" represents the diameter of the recesses 2*b*, 7*e* and "r" represents the diameter of the pins 10.

The refrigerant gas is introduced to the suction chamber 11 through the inlet (not shown) under the orbital movement of the movable scroll 7 and then allowed to flow into the compression chambers P defined between these two scrolls 1, 7. The compression chambers P converge toward the centers of the spiral elements 1*b*, 7*b* as their volumes are reduced under the orbital movement of the movable scroll 7. Thus, the refrigerant gas is compressed in the compression chambers P and discharged through the discharge port 1*c* into the discharge chamber 13. The refrigerant gas in the discharge chamber 13 is fed through the outlet 1*f* to the external refrigerant piping 34.

During the compression of the refrigerant gas, the pressure of the refrigerant gas in the compression chambers P acts upon the movable scroll 7. The force resulting from this pressure is transmitted from the movable pressure receiving wall 7*d* via the pressure receiving elements 9*a* of the ring 9 to the fixed pressure receiving wall 2*a*.

In the first embodiment, the outlet flange 1*e*is formed integrally with the fixed base plate 1*a*on the outer circumference thereof. Accordingly, the size of the rear housing 12 along the axis of the compressor can be reduced compared with the case where the outlet flange is formed on the outer circumference or rear surface of the rear housing 12. Thus, the compressor can be shortened and lightened, which is desirable given the limited engine space of an automobile.

Figure 3:
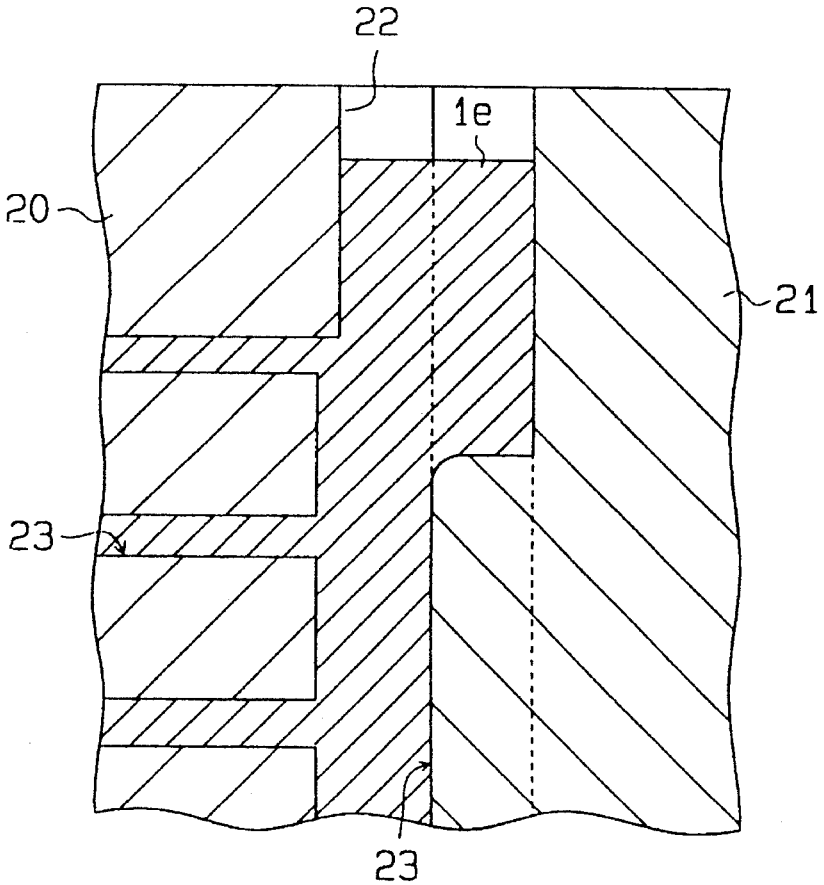
FIG. 3 is a cross-sectional view of the fixed scroll showing how the scroll is molded.

Referring to FIG. 3, with regard to the first embodiment, a columnar section formed in a gate 22 for die-casting a fixed scroll 1 is utilized for forming the outlet flange 1*e*. Accordingly, there is no need of providing any special cavity for forming the outlet flange 1*e*in the dies.

Figure 4:
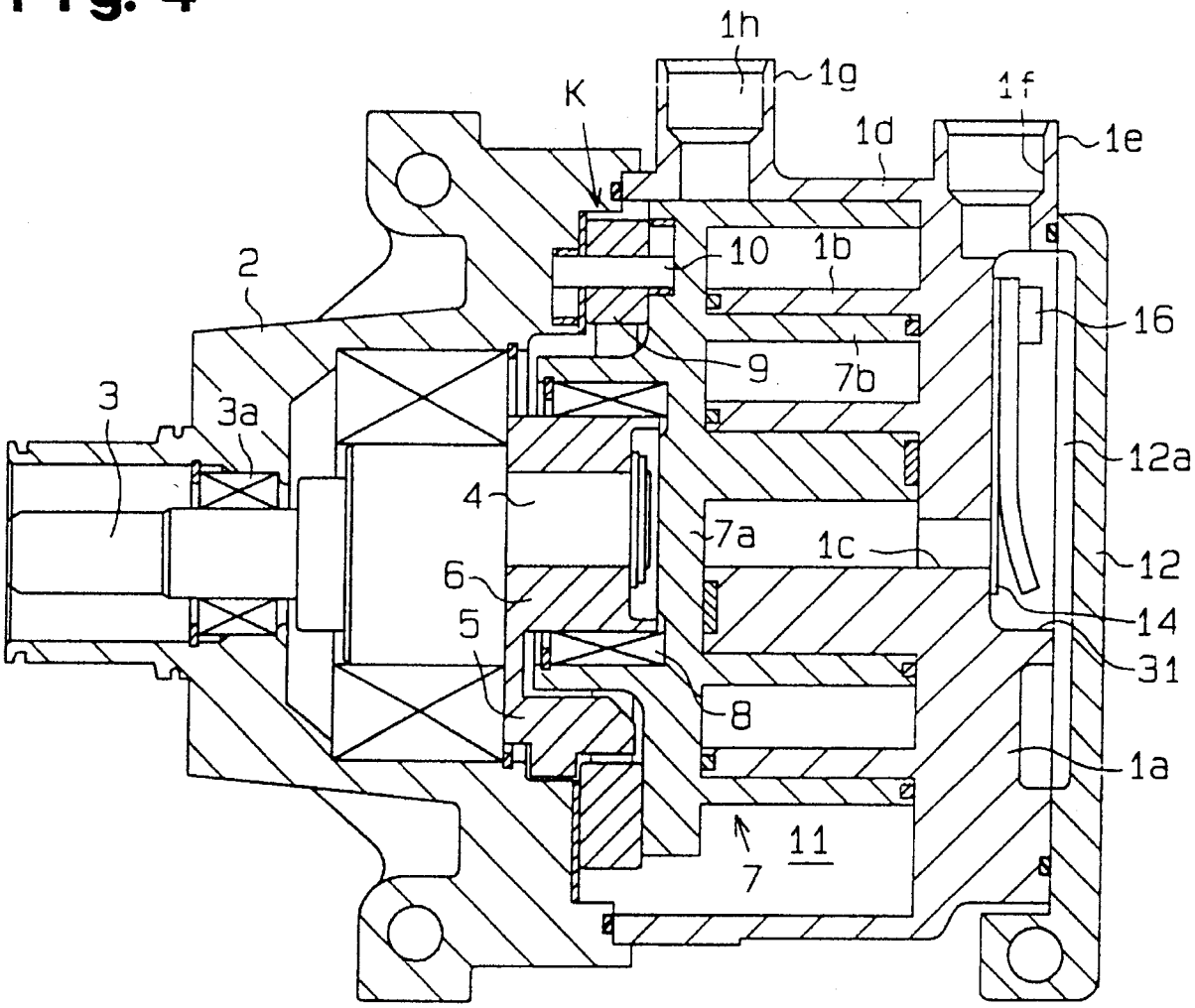
FIG. 4 is a vertical cross-sectional view of the scroll type compressor according to a second embodiment of the invention.

Next, a second embodiment of the present invention will be described referring to FIG. 4. In the second embodiment, an inlet flange 1*g* is formed integrally with a center housing 1*d*on the outer circumference thereof at a front part. An inlet 1*h* communicating to a suction chamber 11 is formed in the flange 1*g* by post-machining.

Accordingly, in the second embodiment, the length of the suction flow path in the compressor and also the loss of suction gas can be reduced. There is no need of providing any inlet flange or complicated flow path in the front housing 2, thus, the shape of the front housing 2 can be simplified, reducing the number of machining steps.

Figure 5:
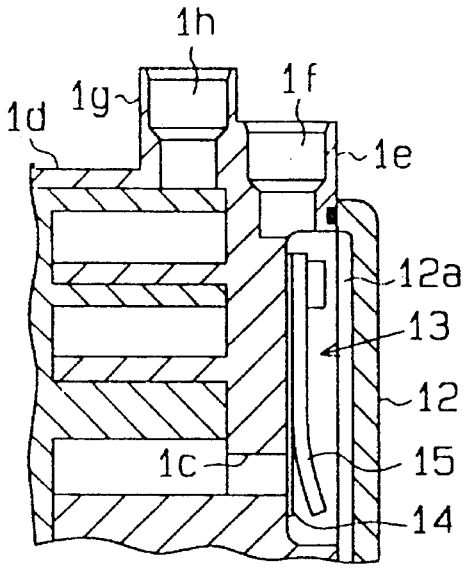
FIG. 5 is a partial vertical cross-sectional view of the scroll type compressor according to a third embodiment of the invention.

A third embodiment of the present invention will be described referring to FIG. 5. In this embodiment, an outlet flange 1*e*and an inlet flange 1*g* are formed adjacent to each other at different heights on the rear part of a center housing 1*d*. The inlet flange 1*g* is formed utilizing a columnar section corresponding to the gate of the mold. In this embodiment, since the flanges 1*e*, 1*g* are formed adjacent to each other, machining of the inlet and outlet can further be facilitated as compared with the second embodiment. In the third embodiment, the height of the flange 1*e*and that of the flange 1*g* may be equal.

Figure 6:
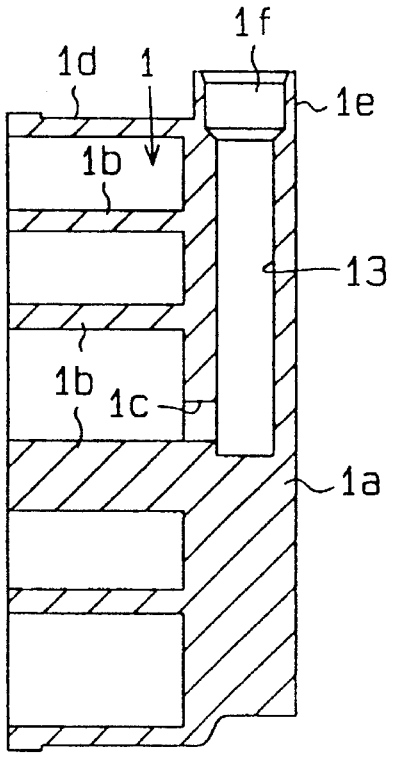
FIG. 6 is a vertical cross-sectional view of the scroll type compressor according to a fourth embodiment of the invention.

A fourth embodiment of the present invention will be described referring to FIG. 6. In this embodiment, the rear housing is omitted, and a discharge chamber 13 is formed within a fixed base plate 1*a*. An outlet flange 1*e*is formed on the outer circumference of the base plate 1*a*as in the first embodiment and is provided with an outlet 1*f* communicating with the discharge chamber 13. Furthermore, the valve 14 for opening and closing the discharge port 1*c* is omitted.

In the fourth embodiment, since the rear housing is omitted, the entire axial length of the compressor can further be reduced compared with the first, second, and third embodiments.

Figure 7:
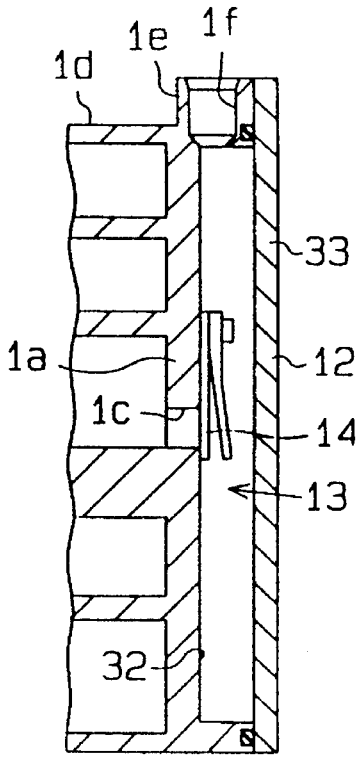
FIG. 7 is a partial cross-sectional view of the scroll type compressor according to another embodiment of the invention.
Figure 8:
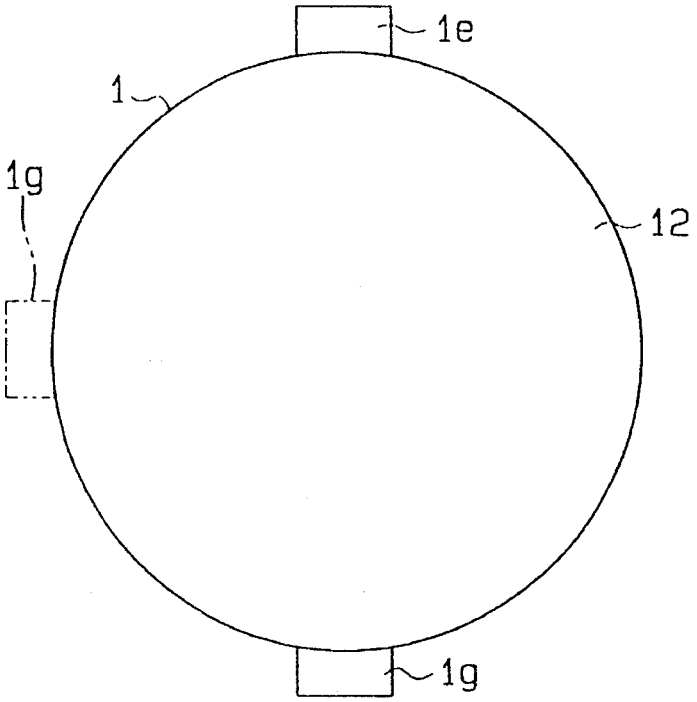
FIG. 8 is a front view of the scroll type compressor according to another embodiment of the invention.
Figure 9:
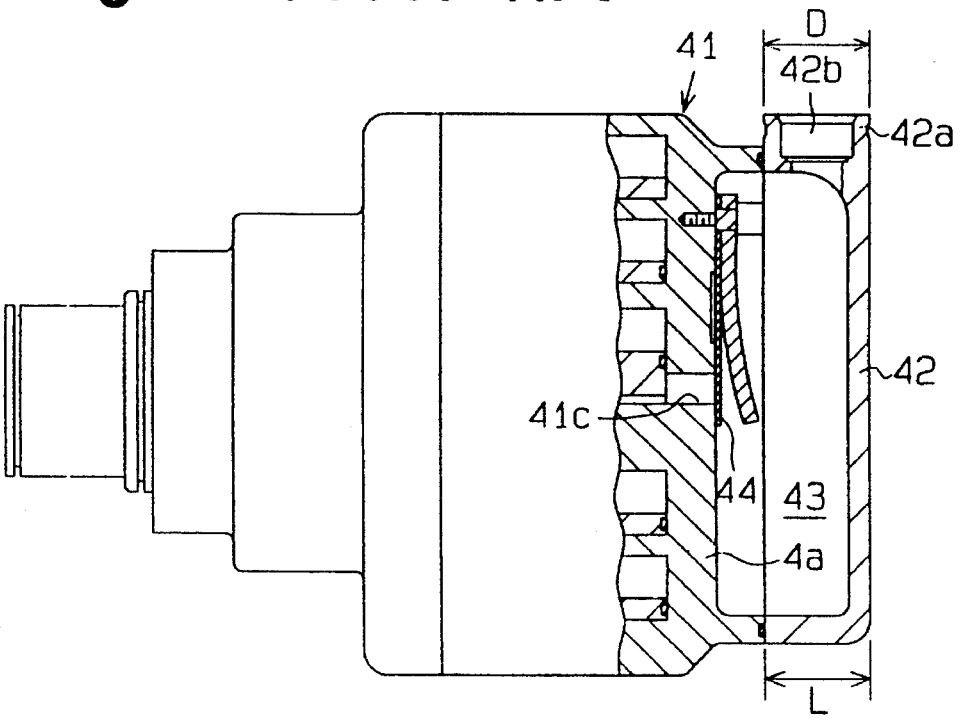
Fig. 9 (Prior Art)
FIG. 9 is a partial vertical cross-sectional view of a prior art scroll type compressor.

It should be understood that the present invention is not to be limited to the embodiments described above but can be embodied as follows:

(1) As shown in FIG. 7, a recess 32 is formed substantially over the entire rear end surface of the fixed base plate 1*a*, and a discharge chamber 13 is formed by covering the recess 32 with a planar cover 33. In this structure, the shape of the rear housing can be simplified so that machining thereof can be facilitated;

(2) As shown in FIG. 8, an outlet flange 1*e*and an inlet flange 1*g* are formed on a center housing 1*d*at a 180 degree or 90 degree interval;

(3) While the center housing 1*d*and the fixed scroll 1 are formed integrally in the above embodiments, the fixed scroll and the center housing may instead be formed separately and assembled. In this case, the center housing 1*d*may be formed integrally with a front housing 2; and (4) The fixed scroll 1 may be formed by molding or by a cold chamber type die-casting method. However, in the case of using the cold chamber type die-casting method, there is a need for providing a portion for forming the flange with the molding dies 20 and 21 in place of the gate.

While the outlet and inlet are described throughout the specification as formed in a "flange", the term "boss" is used in the claims as more aptly descriptive of the structure.

What is claimed is:

1. A scroll type compressor having a fixed scroll in a housing and a movable scroll opposed to the fixed scroll to define a compression chamber with the fixed scroll, wherein gas introduced into a suction chamber via an inlet is compressed in the compression chamber in accordance with the circular movement of the movable scroll and then is discharged to a discharge chamber via a discharge port to exhaust from an outlet providing communication from the discharge chamber to the outside of the compressor, wherein:

the fixed scroll has a spiral element with an adjacent integral base plate, and at least a part of the discharge chamber is defined in the fixed scroll; and wherein an outlet boss protrudes from the outer periphery of the base plate, said outlet boss including the outlet.

2. A compressor according to claim 1 further comprising:

an inlet boss protruding from the fixed scroll, wherein said inlet boss includes the inlet.

3. A compressor according to claim 2, wherein said inlet boss is disposed adjacent to the outlet boss.

4. A compressor according to claim 2, wherein said inlet bboss is disposed spaced from the outlet boss by a predetermined angular interval.

5. A compressor according to claim 1, wherein said fixed scroll is formed by solidifying a molten metal poured into a cavity of a mold via a gate of the mold, and said boss is formed by keeping some molten metal in the gate and solidifying the molten metal kept in the gate.

6. A compressor according to claim 5, wherein said outlet is formed by drilling the solidified metal in the gate.

7. A scroll type compressor having a fixed scroll in a housing and a movable scroll opposed to the fixed scroll to define a compression chamber with the fixed scroll, wherein gas introduced into a suction chamber via an inlet is compressed in the compression chamber in accordance with the circular movement of the movable scroll and then is discharged to a discharge chamber via a discharge port to exhaust from an outlet providing communication from the discharge chamber to the outside of the compressor, said compressor comprising:

a fixed scroll having a base plate formed integral with and adjacent the spiral element of said fixed scroll, said base plate having a recess which forms a part of the discharge chamber;

an outlet boss projecting from the outer periphery of said fixed scroll in the plane of said base plate, said outlet boss including the outlet; and a cover member covering the recess to define the discharge chamber.

8. A compressor according to claim 7, wherein said cover member has an inner space communicating with the recess.

9. A compressor according to claim 7 further comprising:

an inlet boss protruding from the fixed scroll, said inlet boss including the inlet.

10. A compressor according to claim 9, wherein said inlet boss is disposed adjacent to the outlet boss.

11. A compressor according to claim 9, wherein said inlet boss is disposed apart from the outlet boss by a predetermined angular interval.

12. A method for producing a fixed scroll of a scroll type compressor, said fixed scroll having a base plate with a recess for forming a part of a discharge chamber, a spiral element capable of defining a compression chamber with a spiral element of a movable scroll, and an outlet communicating with the discharge chamber, the method comprising the steps of:

solidifying a molten metal poured into a cavity and a gate of a mold through the gate to form as an integral unit the base plate and spiral element of the fixed scroll with an outlet boss;

maintaining solidified metal in the gate to form said outlet boss protruding radially from the periphery of said base plate; and drilling the outlet in the outlet boss.

13. A scroll type compressor having a fixed scroll and a movable scroll opposed to and cooperating with the fixed scroll to define a compression chamber, wherein gas introduced into a suction chamber via an inlet is compressed in the compression chamber in accordance with the circular movement of the movable scroll and is then discharged to a discharge chamber via a discharge port to exhaust from an external outlet providing communication from the discharge chamber to the outside of the compressor, said compressor comprising:

an external housing formed in part by the fixed scroll such that part of the fixed scroll is exposed to the outside of the compressor;

a substantially planar base plate formed integrally with and adjacent a spiral element of said fixed scroll, said base plate having a recess which forms at least a part of the discharge chamber;

the base plate having a solid, substantially planar portion located between the compression chamber and the discharge chamber; and an outlet boss projecting radially from the outer periphery of the base plate and from the external surface of the compressor, said outlet boss including the outlet, wherein a bore forming said outlet reduces the thickness of said base plate planar portion such that the thinnest part of the base plate planar portion, in an axial direction of the compressor, is located between the compression chamber and the outlet bore.

* * * * *

UNITED STATES PATENT AND TRADEMARK OFFICE

CERTIFICATE OF CORRECTION

PATENT NO. : 5,531,579

DATED : July 2, 1996

INVENTOR(S) : T. Fukanuma et al

It is certified that error appears in the above-indentified patent and that said Letters Patent is hereby corrected as shown below:

Column 5, line 48, "bboss" should read --boss--.

Signed and Sealed this

Twenty-eighth Day of January, 1997

*Attest:*

Bruce Lehman

BRUCE LEHMAN

*Attesting Officer*

*Commissioner of Patents and Trademarks*